US005251988A

United States Patent [19]

Frazier

[11] Patent Number: 5,251,988

[45] Date of Patent: Oct. 12, 1993

[54] IN-LINE PRINTER FOR PACKAGING PROCESS

[75] Inventor: Jimmy R. Frazier, Norman, Okla.

[73] Assignee: Burford Corporation, Maysville, Okla.

[21] Appl. No.: 780,770

[22] Filed: Oct. 22, 1991

[51] Int. Cl.[5] ..... B41J 3/02; B41J 11/26; B65H 20/24

[52] U.S. Cl. ..... 400/120; 400/611; 400/614; 101/228; 226/113

[58] Field of Search ..... 101/228, 227, 225, 224, 101/253, 288, 27, 483; 53/131.5, 411; 226/113; 400/120, 611, 613, 614, 618, 619

[56] References Cited

U.S. PATENT DOCUMENTS

| | | | |
|---|---|---|---|
| 1,978,715 | 10/1934 | Meisel | 101/228 |
| 2,089,747 | 8/1937 | Grossmith | 101/228 |
| 2,758,541 | 8/1956 | Tison | 101/228 |
| 3,049,078 | 8/1962 | Smith, Jr. | 101/228 |
| 3,084,841 | 4/1963 | Hata et al. | 226/113 |
| 3,426,680 | 2/1969 | Kaufmann | 101/228 X |
| 3,743,567 | 7/1973 | Abler | 226/113 X |
| 4,033,092 | 7/1977 | Vetter | 53/131.5 X |
| 4,778,093 | 10/1988 | Renold | 226/113 |

FOREIGN PATENT DOCUMENTS

| | | | |
|---|---|---|---|
| 922413 | 2/1955 | Fed. Rep. of Germany | 101/228 |
| 2155711 | 6/1973 | Fed. Rep. of Germany | 101/225 |
| 1149718 | 4/1969 | United Kingdom | 101/228 |
| 2150886 | 7/1985 | United Kingdom | 101/228 |

*Primary Examiner*—Eugene H. Eickholt
*Attorney, Agent, or Firm*—Crutsinger & Booth

[57] ABSTRACT

The thermal transfer printer is an on-line printer to print on a web in packaging apparatus adapted to print either when the web is in motion or during a stop cycle. The printer is configured to interface with a computer having a RS 232C serial port to permit changing messages or product identifications using stored data, fonts and graphics. Thousands of product identifications and descriptions can be stored and called up in minutes. The inker incorporates a web tensioning device which permits feeding a middle portion of the web through a printing nip at a speed different from the speed of the remainder of the web.

21 Claims, 4 Drawing Sheets

IN-LINE PRINTER FOR PACKAGING PROCESS

TECHNICAL FIELD

Packaging apparatus to enclose a product in a printed package wherein a middle portion of a web of packaging material on which a message is printed is momentarily moved at a different speed from the speed of the remainder of the web during a printing cycle.

BACKGROUND OF THE INVENTION

A need exists for apparatus capable of performing in-line printing on packages for products. Bar codes, date of manufacture and similar messages printed on packages in machine readable form are used for inventory control and pricing of products.

Heretofore, printing operations have been performed off-line as a separate operation from the packaging operation. Bags are often constructed and printed prior to delivery to baggers and packaging devices. Pre-printed labels are often applied to packages after the products have been enclosed.

In many packaging operations, a package is formed around the product, for example buns, in a continuous sequence of operations as the products are cooked, sorted, counted or weighed, and positioned to be sealed in a package formed when seal bars engage webs of film material.

Introduction of slack into the system during any phase of the packaging operation can cause trouble in the packaging line affecting other components on the line.

SUMMARY OF THE INVENTION

Packaging apparatus disclosed herein is adapted to enclose a product in a printed package formed of sealed portions of webs of packaging material moved along a path. A printer, adjacent the path, is adapted to print on one of the webs before the webs are joined for forming a package around the product from the webs of packaging material. Generally, web drive apparatus is associated with the package forming device to control movement of the web along the path.

Web tension control apparatus hereinafter described is adapted to control movement of a middle portion of the web moving through the printer, permitting movement of a section of the web through the printer at a surface speed different from the surface speed of the remainder of the web.

The web tension control apparatus is configured to route the web along a serpentine path to form an intermediate section in a middle portion of the web which extends through the printer. A pair of rollers on a tension compensator carriage are positioned relative to idler rollers at the infeed and delivery ends of the printer to form an infeed bight and a take-up bight in the intermediate section of the web. Web material in the infeed bight is transferred to the take-up bight such that the surface speed of the web in the intermediate section of the web is different from the surface speed of the remainder of the web. The printer forms an image on the intermediate section of the web between the infeed bight and the take-up bight.

DESCRIPTION OF DRAWINGS

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
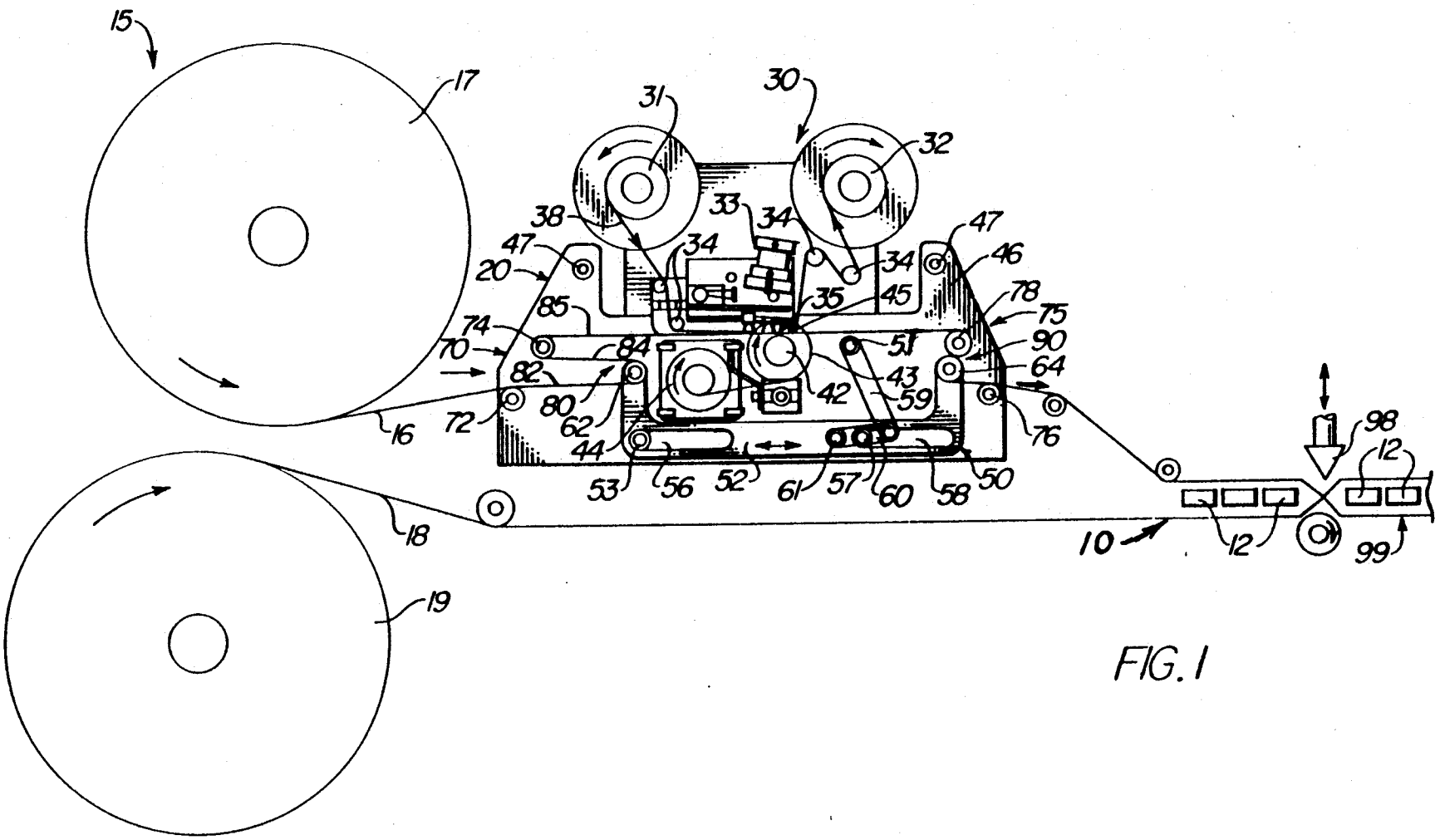
FIG. 1 is a diagrammatic view illustrating a thermal transfer printer in a packaging line.

Referring to FIG. 1 of the drawing, the numeral 10 generally designates packaging apparatus which forms a package 99 on which images are printed around one or more products 12. The packaging apparatus includes a film feeder 15 supporting spools 17 and 19 of packaging material from which a top web 16 and bottom web 18 are dispensed.

The top web 16 is routed through a printer 20 where a message is printed on the web.

The power supply 22 for the printer 20 can be remotely mounted to reduce the size and bulk of the printer. The power supply is preferably mounted next to the computer 25. All connections are to or through the power supply 22 to hold the connecting cables to minimums.

The size of the computer 25 depends on the size of the application, and the amount of program storage required. Some applications only require a small laptop computer with question and answer programs. Other applications will require a large data base system complete with multiplexing capabilities.

The computer serves as a storage device for long term information.

The particular embodiment of printer 20 illustrated in FIG. 1 of the drawing is a thermal transfer printer which transfers ink from a ribbon 38 dispensed from a supply spool 31 around guide rollers 34, below a print head 35 and onto a take-up roller 32. An air cylinder 33 raises and lowers print head 35 to form a printing nip 45 between print head 35 and a platen roller 42.

As will be hereinafter more fully explained, print head 35 prints a message on web 16 when the print head is moved downwardly by air cylinder 33 as the web 16 is advanced by platen 42.

Web tensioning apparatus 50 includes a carriage 55 formed by pair of spaced slide plates 52 and 54 having guide slots 56 and 58 formed therein and supported by rollers 53 and 57 extending outwardly from printer side frames 46 and 48.

Side frames 46 and 48 are of substantially identical construction, one of the side frames being mounted adjacent opposite sides of webs 16 and 18. Tie bars 47 extend transversely across web 16 for securing side frames 46 and 48 together. A pair of infeed idler rollers 72 and 74 are rotatably secured between side frames 46 and 48 adjacent the infeed end 70 of printer 20. A pair of idler rollers 76 and 78 are rotatably secured between side frames 46 and 48 adjacent the delivery end 75 of printer 20.

A pair of idler rollers 62 and 64 are rotatably mounted on and extend between slide plates 52 and 54 on carriage 55. As will be hereinafter more fully explained, rollers 62 and 64 move in opposite directions in unison relative to printing nip 45.

The platen roller 42 is driven by a platen drive motor 44 through a drive belt 43 which extends around a pair of pulleys, one of which is mounted on the drive shaft of motor 44 and the other on the end of platen roller 42. Motor 44 is bolted or otherwise secured to side frame 46 of printer 20.

To assure that slider plates 52 and 54 move in unison, a shaft 51 is rotatably supported between side frames 46 and 48 of printer 20. A pair of crank arms 59 have ends welded or otherwise secured to spaced locations adjacent opposite ends of cross shaft 51 and have lower ends pivotally secured to one end of a pivot arm 60. The opposite end of each pivot arm 60 is pivotally secured by a pin 61 to one of the slider plates 52 or 54.

Idler rollers 72 and 74 adjacent the infeed end 70 of printer 20 and idler rollers 76 and 78 adjacent the delivery end 75 of printer 20 have opposite ends rotatably secured to side frames 46 and 48 and rotate about spaced parallel axes. Rollers 62 and 64 have opposite ends rotatably supported in slide plates 52 and 54 on carriage 55 and rotate about axes which are spaced from and parallel to the axes of idler rollers 72, 74, 76 and 78. However, rollers 62 and 64 are free to rotate while oscillating in unison between the infeed end 70 and delivery end 75 of printer 20. It should be readily apparent that the distance moved by rollers 62 and 64 is substantially equal to the length of slots 56 and 58 into which rollers 53 and 57 extend.

Referring to FIG. 1 of the drawing, top web 16 is dispensed from a spool 17 and is routed to the infeed end 70 of printer 20 over idler roller 72. Web 16 then extends around rollers 62 and 74 to form a storage bight 80 formed by flights 82 and 84 of web 16. A middle portion 85 of web 16 extends through the printing nip 45 between print head 35 and platen roller 42.

The middle portion 85 of web 16 is routed from printing nip 45 around idler roller 78, roller 64 and idler roller 76 in route to the delivery end 75 of printer 20 to form a dispensing bight 90 formed by flights 92 and 94.

From the foregoing, it should be readily apparent that if web 16 is stopped such that idler rollers 72 and 76 are not rotating, when platen drive motor 44 is energized, platen roller 42 will rotate thereby moving the middle portion 85 of web 16 through the printing nip 45.

Since the carriage 55 of web tensioning apparatus 50 is not restrained against movement, web material is dispensed from bight 80 as roller 62 moves toward the infeed end 70 of printer 20 while web material is stored in the delivery bight 90 as roller 64 moves toward the infeed end 70 of printer 20. Since rollers 62 and 64 move the same distance in unison, the middle portion 85 of web 16 can be moved through nip 45 without moving or changing the tension in the remaining portion of web 16.

After a message has been printed on the middle portion 85 of web 16, top web 16 and bottom web 18 are routed around rollers to permit a predetermined number or quantity of products 12 to be positioned between webs 16 and 18. Conventional sealing apparatus 98 heat seals, sews or otherwise joins webs 16 and 18 to form a package 99 containing products 12.

Webs 16 and 18 may be driven to intermittently advance webs 16 and 18 while products are being positioned and packages 99 are being formed by conventional equipment in line with printer 20. It should be readily apparent that webs 16 and 18 may be continuously driven in certain packaging operations.

Figure 2:
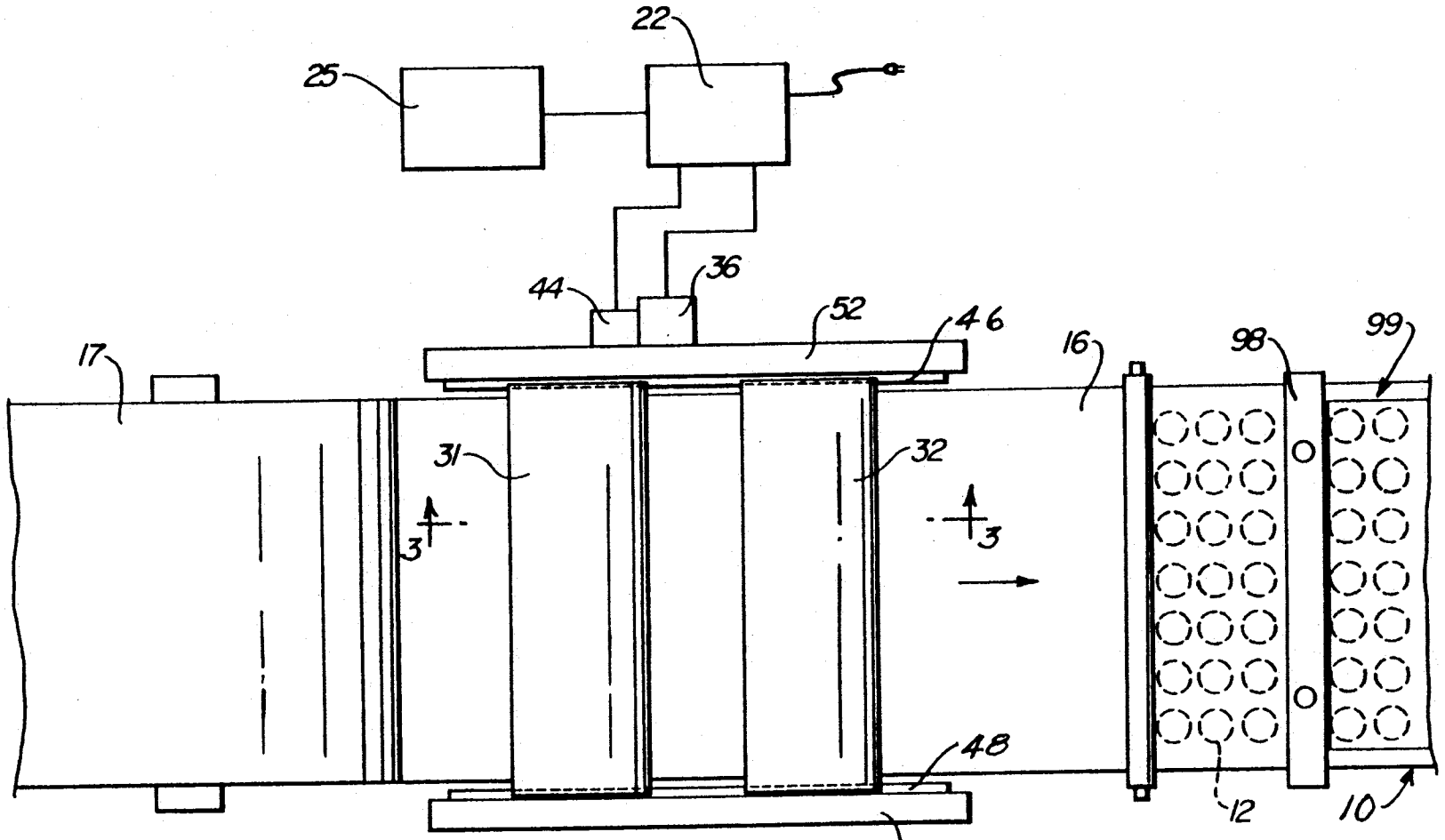
FIG. 2 is a top plan view of the packaging line.

Thermal transfer printer 20 is illustrated in FIGS. 1 and 2 in a bulk packaging line application to package a number of hamburger or hot dog buns. The thermal transfer printer 20 prints a message on the web 16 of polyethylene film.

The thermal transfer printer 20 transfers ink from ribbon 38 onto the web 16 of film to provide information such as the packaging date, ingredients, time of packaging or similar information.

The print head 35 is moved up and down by an air cylinder. When print head 35 is down, it prints the message on the web 16 of film being advanced by platen roller 42.

The message is supplied to the print head 35 by a circuit board memory ram inside the printer case. Individual messages are stored on computer 25 external to the thermal transfer printer 20 and when the operator wants to change a message he downloads a new message into the control board for the printer. The operator then is able to print a different message indefinitely until he wants to change the message again at which point he downloads another message from the computer 25.

It should be appreciated that during the printing process itself film is not pulled off the spool 17 or supplied down stream. When a message is printed the middle portion 85 of web 16 of film advances under the print head 35. However, the film has not advanced off the spool 17 and the film is not advanced down stream of the printer 20. Film has been supplied from the infeed bight 80 and taken-up by the dispensing bight 90 entirely within the frame of the printer 20. However, it should be appreciated that rollers 62 and 64 may be positioned at other locations in the line so long as the movement of roller 62 is synchronized with movement of roller 64 and one is positioned on one side of the printing nip 45 and the other on the other side.

The carriage 55 moves back and forth as the message is printed and then the film is advanced. The purpose of the carriage 55 is to move two rollers 62 and 64 at the same speed and in the same direction at the same time. Since rollers 62 and 64 are tied together by slide plates 52 and 54, when one moves a given distance the other one moves exactly that same distance. This prevents slack being introduced into the system.

Normally carriage 55 would be in the forward position, down stream of the direction of flow. The print head 35 comes down urging the web into engagement with the platen roller 42 which drives the web. In the process of printing a message, the carriage 55 will be driven a distance which is half the length of the message that's printed. At the end of the print cycle, the tension compensator carriage 55 will be positioned toward the infeed end 70 of the printer 20, as illustrated in dashed outline in FIG. 1. As the film is pulled by the packaging machine downstream, the carriage 55 will automatically return to the forward position, illustrated in full outline. No springs, actuators, or sensors are required to control and move the carriage 55 to maintain tension on the web of film at all times.

It should be appreciated that the web tensioning apparatus 50 can be of various widths, typically anywhere from a foot up to three or four feet wide depending upon what task is being performed. The machines may be right hand units or left hand units. They can be mounted in almost any orientation including upside down.

SECOND EMBODIMENT

Figure 4:
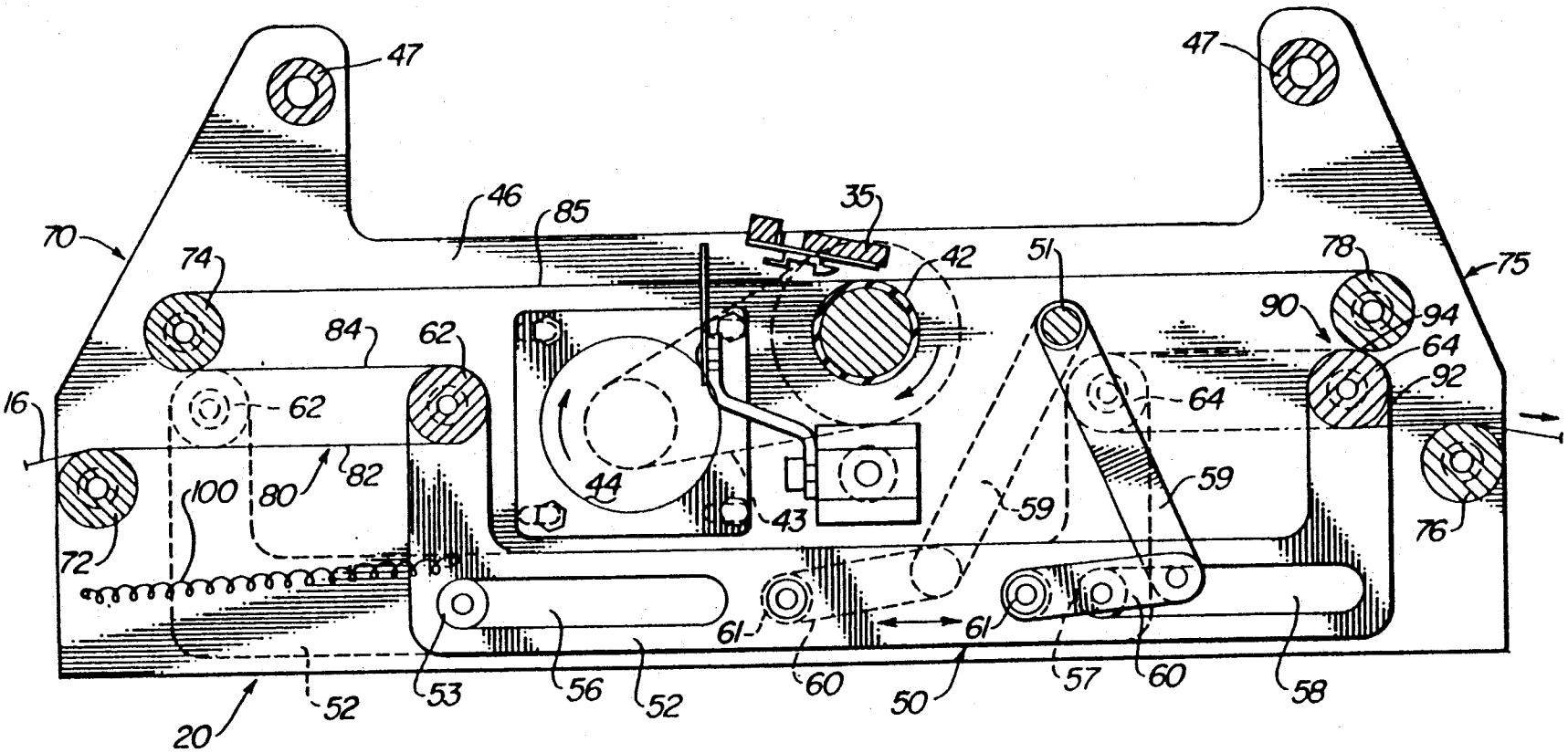
FIG. 4 is a cross-sectional view similar to FIG. 3 of a modified form of the web tensioning device.

In the embodiment illustrated in FIG. 4, the film tension compensator is used in a slightly different mode. The same parts which have been described hereinbefore are designated by like reference numerals. However, it should be noted that a spring 100 loads the slide carriage 55 toward the infeed side 70 of the thermal transfer printer 20 for biasing slide plates 52 and 54 toward the infeed end 70 of printer 20. Thus, if web 16 is moving at a constant speed of, for example, 20 feet per minute and print head 35 is only capable of printing at a surface speed of 5 feet per minute, platen roller 42 will slow down the middle portion 85 of web 16 momentarily while print head 35 is printing a message. When the middle portion 85 of web 16 is slowed down relative to the remainder of web 16, web material will be drawn from bight 90 adjacent the delivery end 75 of printer 20 while excess web material will be temporarily stored in bight 80 adjacent the infeed end 70 of printer 20.

If the printer 20 is capable of printing at a speed of 4½ inches per second, the web of film in the packaging line could be moving quite a bit faster, possibly 15 or 20 inches per second. A message can be printed onto the film by temporarily slowing down the film speed under the print head 35 to 4½ inches per second but allowing the film at the delivery end 75 of the thermal printer 20 to continue to move out at whatever speed is being called for, for example 15 or 20 inches per second.

The film tension compensator carriage moves during the print cycle and supplies film to the delivery while the printer 20 is actually printing. The film speed through the printer itself varies from full speed to printer speed and then actually slightly more than the average speed. So immediately after the printing is completed, the web 16 moves away from the printing nip 45 at a speed which is a greater than the average speed that is being called for by the packaging machine. The carriage 55 moves forward with every print, that means it is supplying film down stream to maintain it at a constant speed even though the speed through the printer 20 is occasionally slowing down.

It should be noted that there is always exactly 180° of film wrap around the rollers 62 and 64, regardless of the position of carriage 55, as it travels from the forward position back to the rearmost position or any point in between. Therefore, when the roller moves one inch, two inches of film is moved. By the same token on the other end where the other roller is located, when it moves one inch it takes up two inches of film.

Therefore, when the carriage 55 moves, one end applies film and the other end takes up film at exactly the same amount and they are tied together by a frame which causes both rollers 62 and 64 to move the same amount at the same time. The linkage 59 is provided to assure that both ends of the film tension compensator slide plates 52 and 54 move exactly the same amount so that carriage 55 does not tend to get skewed or pinched in any way.

Figure 3:
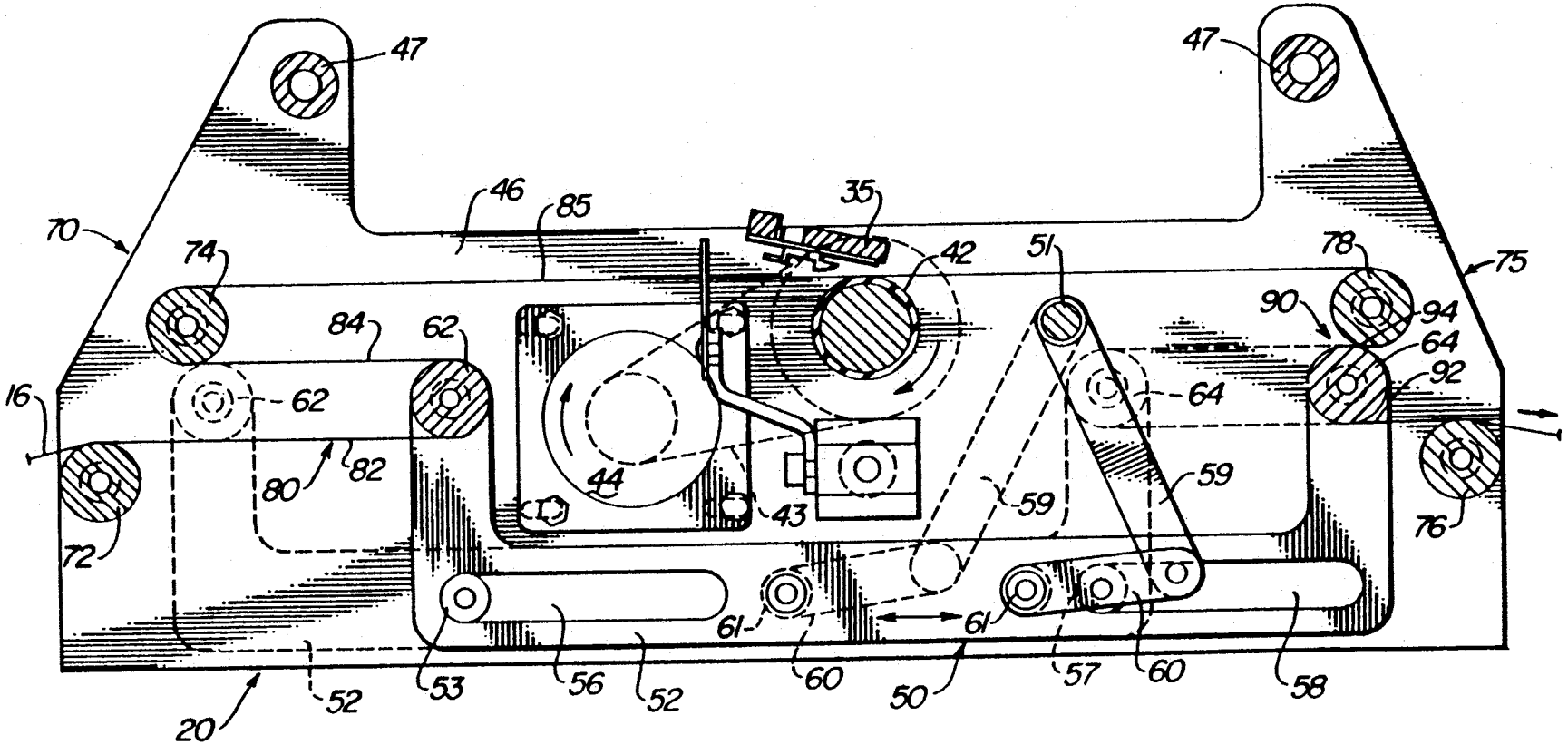
FIG. 3 is a cross-sectional view taken along line 3—3 of FIG. 2.

The carriage 55 is preferably moved entirely by the forces on the web of film and automatically returns itself to the forward position after each print cycle as the result of the film being pulled downstream by the packaging machine, in the embodiment illustrated in FIG. 3. However, in the embodiment illustrated in FIG. 4 spring 100 biases carriage 55 to a preferred position. It should be appreciated that other and further biasing apparatus such as an air cylinder, solenoids and the like may be employed for particular applications.

It should be readily apparent that other conventional packaging apparatus which forms a tube by folding a single web and sealing sections to form a package may be employed and is contemplated in the invention.

I claim:

1. A method of printing on a web of material comprising the steps of: moving a web along a serpentine path around rollers on a carriage to form an intermediate section in a middle portion of the web and a remaining portion of the web; forming first and second bights in the intermediate section of the web; moving the remaining portion of the web at a first surface speed; moving the intermediate section of the web at a second surface speed different from the first surface speed of the remaining portion of the web such that tension in the web moves the carriage for storing web material in the second bight and dispensing web material from the first bight; printing an image on the intermediate section of the web; and moving the intermediate section of the web at a third surface speed to store web material in the first bight.

2. A method of printing according to claim 1, wherein the step of moving a web comprises the steps of: alternately advancing and stopping the web; and moving the middle portion of the web through a printing nip while the remaining portion of the web is stopped without changing tension in the remaining portion of the web.

3. A method of printing according to claim 1, wherein the step of moving a web comprises the steps of: moving the middle portion of the web through a printing nip at a surface speed which is less than the surface speed of the remaining portion of the web during a printing portion of a cycle of operation; and advancing the middle portion of the web through the printing nip at a surface speed greater than the surface speed of the remaining portion of the web during a web advance portion of a cycle of operation.

4. A method of printing according to claim 1, wherein the step of printing an image on the intermediate section of the web comprises the steps of: moving the intermediate portion of the web through a printing nip between a platen roller and a computer controller thermal transfer print head, said platen roller driving said intermediate section of said web at a surface speed different from the remaining portion of the web.

5. Packaging apparatus adapted to enclose a product in a printed package comprising: means to move a web, including a middle portion of web and a remaining portion of web, of packaging material along a path at a surface speed; printer means adjacent said path adapted to print on the middle portion of the web; means adjacent said path for positioning a product adjacent said web; package forming means adjacent said web forming a package from said web of packaging material around the product; drive means associated with said package forming means adapted to control movement of said web along said path; web drive means adjacent said printer means to drive said middle portion of said web at a surface speed which is different from the surface speed of said remaining portion of the web; and web tension control means moved by tension in said middle portion of said web permitting intermittent movement of a section of said web through said printer means at a surface speed different from the surface speed of the remainder of the web.

6. Packaging apparatus adapted to enclose a product in a printed package according to claim 5, said web tension control means comprising: means routing said web along a serpentine path to form an intermediate section in a middle portion of said web; means forming an infeed bight and a take-up bight in said intermediate section of said web; means for delivering web material in said infeed bight to said take-up bight such that the surface speed of said web in said intermediate section of said web is different from the surface speed of said remaining portion of said web; and means supporting said printing means to form an image on said intermediate section of said web between said infeed bight and said take-up bight.

7. Packaging apparatus adapted to enclose a product in a printed package according to claim 6, said web tension control means further comprising: means for storing web material in an infeed bight and dispensing web material from a take-up bight.

8. Packaging apparatus adapted to enclose a product in a printed package according to claim 6, said means forming an infeed bight and a take-up bight in said intermediate section of said web comprising: carriage means; and roller means on said carriage means adjacent opposite ends of said serpentine path.

9. Packaging apparatus adapted to enclose a product in a printed package according to claim 8, said carriage means comprising: spaced slide plates; and means to move said carriage means linearly to change the length of an infeed portion of said serpentine path and a dispensing portion of said serpentine path.

10. Printing apparatus comprising: a pair of side frames; printer means having an infeed end and a delivery end; means forming a printing nip in said printer means between said side frames; means for moving a web of material between said side frames; means routing a middle portion of said web through said printing nip; web storage means adjacent one side of said printing nip; web dispensing means adjacent the other side of said printing nip; and regulator means associated with said web storage means and said web dispensing means, said regulator means being controlled by tension in said middle portion of said web for causing excess web material to be simultaneously dispensed from said storage means and taken-up by said dispensing means such that the surface speed of said middle portion of said web at said printing nip is different from the surface speed of said web adjacent said infeed and said delivery ends of said printer means.

11. Printing apparatus according to claim 10, said web storage means comprising: means forming an intermediate section in a middle portion of said web; means forming an infeed bight in said intermediate section of said web adjacent one side of said printing nip; means forming a take-up bight in said intermediate section of said web adjacent said delivery end of said printer means.

12. Printing apparatus according to claim 11, said regulator means comprising: means associated with said means forming an infeed bight and said means forming a take-up bight for controlling movement of said middle portion of said web between said infeed bight and said take-up bight in said intermediate section of said web.

13. Printing apparatus according to claim 10, said means forming an infeed bight and said means forming a take-up bight comprising: spaced roller means adjacent opposite sides of said printing nip movably secured to move in unison toward and away from said printing nip.

14. Printing apparatus according to claim 13, said means supporting said roller means to move in unison comprising: slide means rotatably supporting opposite ends of said roller means; and means secured between said side frames and said slide means supporting said roller means for rotation about spaced axes extending perpendicular to the length of the web.

15. Printing apparatus according to claim 10, said regulator means including: means to intermittently advance and stop said web; and means to move said middle portion of said web through said printing nip when said web is stopped.

16. Printing apparatus according to claim 10, said regulator means comprising: means to move said web at a substantially constant surface speed; and means to move said middle portion of said web through said printing nip at a surface speed which is different from the substantially constant surface speed of said web.

17. Printing apparatus according to claim 16, said means to move said middle portion of said web comprising: a platen roller; and means for driving said platen roller such that its surface moves at a surface speed different from the surface speed of said web for moving said middle part of said web through said printing nip.

18. Printing apparatus according to claim 10, said means forming a printing nip comprising: a platen roller; print head means adjacent said platen roller; and means associated with said print head means forming images on the surface of a portion of said middle portion of said web adjacent said platen roller.

19. Printing apparatus according to claim 18, said means associated with said print head means forming images on the surface of a portion of said middle portion of said web adjacent said platen roller comprising: computer means; and means connecting said computer means and said print head such that said computer means controls the image printed by said print head.

20. Printing apparatus according to claim 10, with the addition of a first pair of idler rollers adjacent said infeed end of said printer means and a second pair of idler rollers adjacent said delivery end of said printer means, said web storage means comprising: infeed roller means mounted for movement relative to said first pair of idler rollers; and said web dispensing means comprising: dispensing roller means adjacent said second pair of idler rollers, said regulator means moving said infeed roller means and said dispensing roller means in unison relative to said printing nip.

21. Printing apparatus according to claim 20, said regulator means comprising: guide means secured to said side frames; slide means secured between said infeed roller means and said delivery roller means; and means supporting said slide means on said guide means such that tension in said web adjacent said delivery end of said printer means reciprocates said slide means.

* * * * *

UNITED STATES PATENT AND TRADEMARK OFFICE

CERTIFICATE OF CORRECTION

PATENT NO. : 5,251,988

DATED : Oct. 12, 1993

INVENTOR(S) : Jimmy R. Frazier

It is certified that error appears in the above-indentified patent and that said Letters Patent is hereby corrected as shown below:

Column 6, line 45, change "controller" to read --controlled--

Signed and Sealed this

Twenty-second Day of March, 1994

*Attest:*

Bruce Lehman

BRUCE LEHMAN

*Attesting Officer*

*Commissioner of Patents and Trademarks*